US005237766A

United States Patent [19]

Mikolay

[11] Patent Number: 5,237,766

[45] Date of Patent: Aug. 24, 1993

[54] ILLUMINATED SIGN

[75] Inventor: Ray M. Mikolay, Lake Zurich, Ill.

[73] Assignee: Thos. A. Schutz & Co., Morton Grove, Ill.

[21] Appl. No.: 693,333

[22] Filed: Apr. 29, 1991

[51] Int. Cl.[5] ..... G09F 13/04

[52] U.S. Cl. ..... 40/564; 40/454; 40/580

[58] Field of Search ..... 40/454, 489, 541-545, 40/552, 558, 563, 564, 568-570, 575, 576, 579, 580

[56] References Cited

U.S. PATENT DOCUMENTS

| | | | |
|---|---|---|---|
| 1,311,472 | 7/1919 | Van Bloem | 40/552 |
| 1,479,485 | 1/1924 | Van Bloem | 40/563 |
| 1,786,155 | 12/1930 | Farrell | 40/580 |
| 2,197,353 | 2/1940 | Poblocki | 40/576 |
| 2,524,294 | 10/1950 | Marsh | 40/552 |
| 3,968,584 | 7/1976 | Kingston . | |
| 4,077,146 | 3/1978 | Nasgowitz . | |
| 4,373,282 | 2/1983 | Swartz . | |
| 4,602,448 | 7/1986 | Grove | 40/541 |
| 4,711,044 | 12/1987 | Danjell . | |
| 4,796,170 | 1/1989 | Pedersen et al. . | |
| 4,860,171 | 8/1989 | Kojima . | |
| 4,891,896 | 1/1990 | Boren . | |
| 4,924,356 | 5/1990 | French et al. . | |
| 4,967,317 | 10/1980 | Plumly | 40/570 |
| 4,976,057 | 12/1990 | Bianchi . | |
| 5,009,019 | 4/1991 | Erlendsson et al. | 40/543 X |

FOREIGN PATENT DOCUMENTS

| | | | |
|---|---|---|---|
| 612988 | 8/1956 | Canada | 40/543 |

*Primary Examiner*—Kenneth J. Dorner
*Assistant Examiner*—Brian K. Green
*Attorney, Agent, or Firm*—Wood, Phillips, VanSanten, Hoffman & Ertel

[57] ABSTRACT

An illuminated sign consisting of: a message carrying wall having a front display side and a rear side, with the message carrying wall having a portion that is opaque to block light transmission therethrough from a source on the rear side of the message carrying wall and a transparent and/or translucent portion that allows light transmission therethrough from a source at the rear side of the message carrying wall to produce an illuminated message that is visually detectable at the front side of the message carrying wall; and a lenticular structure at the front of the message carrying wall for intercepting light transmitted from a source on the rear side of the message carrying wall through the transparent and/or translucent portion of the message carrying wall to diffuse the light in such a way as to give the appearance of a light source being at the front of the message carrying wall.

16 Claims, 3 Drawing Sheets

ILLUMINATED SIGN

BACKGROUND OF THE INVENTION

1. Field of the Invention

This invention relates to signs and, more particularly, to a sign with an illuminated message that simulates the appearance of a neon sign.

2. Background Art

For over half a century, neon signs have been extensively used in advertising, particularly on store fronts and the like. Neon signs are desired for their intensity and their three dimensional look. Bright colors can be observed over a wide viewing angle.

Neon signs, however, have numerous drawbacks First of all, the signs are constructed by bending glass tubing Intricate bending steps are often required to produce a desired message. As a result, relatively highly skilled labor is required to manufacture such signs.

A further drawback with conventional neon signs is that each colored tube must be constructed with its own circuit. This often results in a maze of tubing which is unsightly when viewed at close range.

A further drawback with conventional neon tubes is that they are prone to breakage The glass tubing must be sufficiently thin to facilitate its bending. Further, the tubes, upon being bent, may be stretched so as to become thinner and even more brittle. Accidental bumping of the tubes could cause rupture thereof that releases the confined gas and requires reconstruction of an entire circuit.

A further drawback with neon signs is that they require transformers which are not only unsightly but prone to failure. It is very common to see certain circuits of neon signs flickering undesirably, which detracts from the appearance of the sign. It is also common for a failing transformer to produce an annoying humming noise which may be audible from a substantial distance away from the sign.

While the above problems have plagued the advertising industry for years, designers have contended with these problems for want of an alternative that produces a colorful, intense, three dimensional message comparable to the neon sign.

SUMMARY OF THE INVENTION

The present invention is specifically directed to overcoming the above enumerated problems in a novel and simple manner. The present invention has as its principal objective the production of a relatively inexpensive sign that imitates the appearance of neon by magnifying/redirecting light from a conventional source, such as a fluorescent tube.

More particularly, the present invention comprehends an illuminated signal consisting of: a message carrying wall having a front display side and a rear side, with the message carrying wall having a portion that is opaque to block light transmission therethrough from a source on the rear side of the message carrying wall and a translucent portion that allows light transmission therethrough from a source at the rear side of the message carrying wall to produce a message that is visually detectable at the front side of the message carrying wall; and a lenticular structure at the front of the message carrying wall for intercepting light transmitted from a source on the rear side of the message carrying wall through the transparent or translucent portion of the message carrying wall to magnify/redirect the light in such a way as to give the appearance of a light source being at the front of the message carrying wall.

In one form, the message carrying wall is made up of first and second panels, the first panel defining the lenticular structure and the second panel being opaque and defining cut-outs for the lenticular structure which projects forwardly through the cut-outs with the first and second panels in operative relationship. The lenticular structure produces a raised, illuminated message projecting forwardly from the exposed front surface of the device, which surface is normally planar.

The invention also contemplates the combination of the message carrying wall with a light source.

To avoid light voids in the message, as viewed from the front of the device, reflectors are provided rearwardly of the light source. With a fluorescent type bulb, a large portion of the light is projected directly forwardly from the bulb. The reflector is arranged to intercept light projecting rearwardly from the bulb and divert that light back to the message carrying wall. The rebounding rearwardly directed light rays tend to fill the voids that might otherwise exist in the absence of the reflectors. In one form, the deflector defines a U-shaped, generally conforming, spaced receptacle for the fluorescent tube. In another form of the reflector, the light source resides between two oppositely facing reflecting surfaces which are angularly inclined with respect to each other and converge from front to rear in the device.

To further eliminate any voids that might be visible from the front of the device, a reflective coating is provided on a rear surface of the portion of the message carrying wall that is opaque. A white latex finish has proven effective for this purpose and reflects light that does not project into the transparent and/or translucent portion of the message carrying wall back to the reflector for dispersion in a forward direction.

In a preferred form, the lenticular structure is made up of at least one raised element, and preferably a plurality of raised elements which cooperatively produce a message viewable from the front of the sign. The raised element, in cross section, has a generally solid U-shaped configuration with a convex forward surface. Preferably, the forward surface is defined by an arc of a circle having a first diameter and two spaced, straight segments extending from the arc substantially tangent thereto. In one form of the invention, the forwardmost surface segment has an apex which is spaced from the forwardly facing panel surface at the front of the device by a distance less than the first diameter. In one preferred form, the first diameter is approximately equal to $\frac{3}{8}$ inch and the distance between the apex of the convex surface segment and the forwardly facing panel surface is approximately equal to $\frac{1}{4}$ inch.

The first panel can be tinted with at least one color so that light projecting forwardly through the transparent and/or translucent portion of the message carrying wall has the one color. Any number of colors can be employed depending on the preference of the user.

In one form, the lenticular structure is molded from an acrylic or polycarbonate material.

DETAILED DESCRIPTION OF THE DRAWINGS

Figure 1:
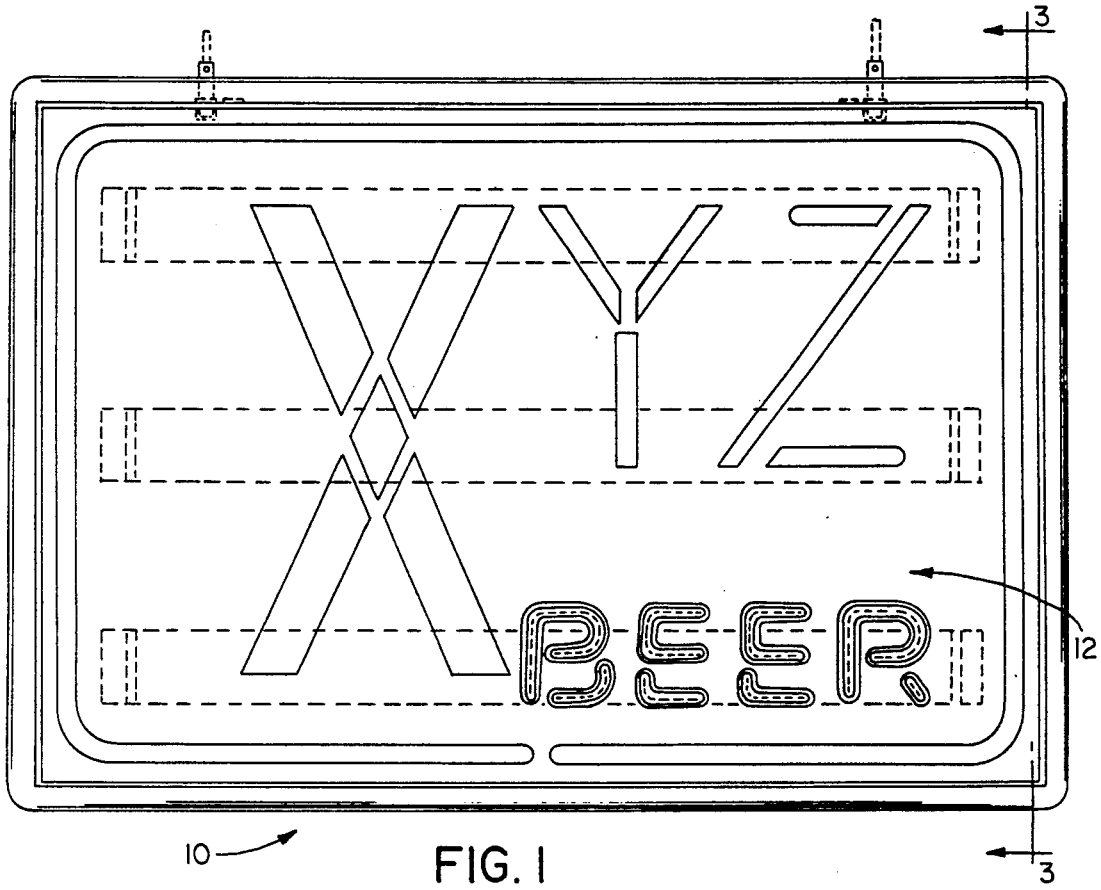
FIG. 1 is a front elevation view of an illuminated sign made according to the present invention.
Figure 2:
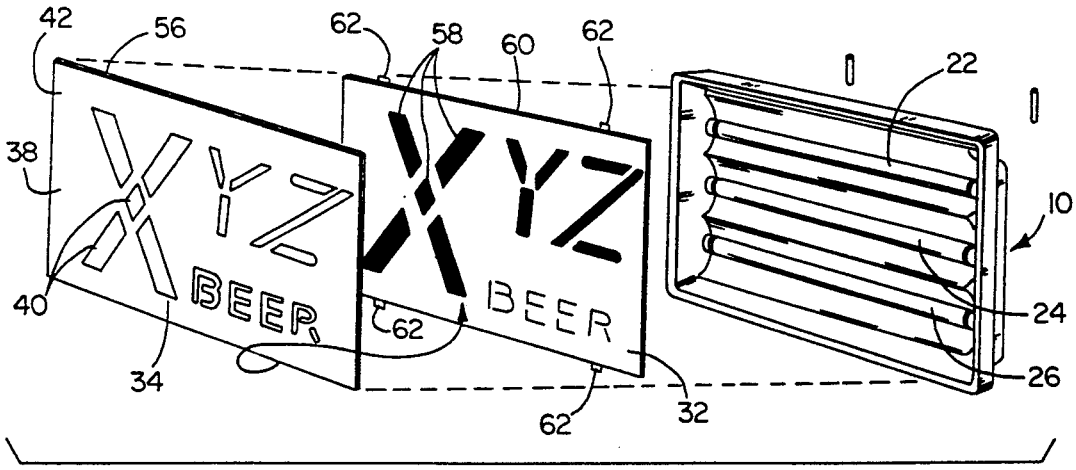
FIG. 2 is an exploded perspective view of the sign of FIG. 1.
Figure 3:
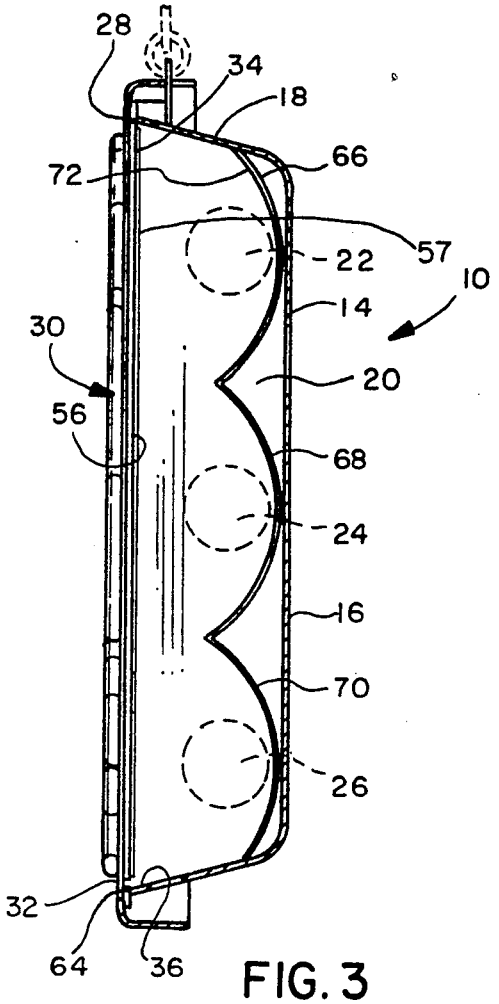
FIG. 3 is a cross-sectional view of the sign taken along line 3—3 of FIG. 1.

In FIGS. 1-3, a preferred form of illuminated sign, according to the present invention, is shown at 10. The sign 10 has a message 12 viewable from the front thereof. The message shown is the subject of U.S. Trademark Registration No. 1,385,379, owned by Miller Brewing Company of Milwaukee, Wis. The message 12 in FIGS. 1 and 2 is shown strictly for purposes of illustration, as normally the message on the signs 10 will be custom made for each consumer.

The sign 10 consists of a rectangular housing 14 having a rear wall 16 and an integral, forwardly projecting peripheral wall 18. The walls 16, 18 cooperatively define a forwardly opening component receptacle/space 20 for, in this case, three conventional fluorescent tubes 22, 24, 26 which make up the light source for the sign 10.

At the open forward edge 28 of the housing 14, a message carrying wall at 30 is provided. The message carrying wall 30 is made up of a front panel 32 and a rear panel 34, each having substantially the same rectangular shape to fit closely within a conforming opening 36 at the front of the housing 14.

The rear panel 34 is preferably molded in one piece and includes a body 38 and raised, lenticular letters 40 projecting forwardly from a generally planar surface 42 on the body 38. The entire panel 34 is preferably molded from a clear material, such as acrylic or polycarbonate. The letters may be polished for clarity, however, with known molding techniques, this is generally unnecessary.

The raised letters 40 act to magnify light from the bulbs 22, 24, 26 and to effect dispersion thereof. With the panel 34 in the operative position of FIGS. 1 and 3, the raised, lenticular letters 40 give the appearance of a three dimensional light source at the front of the housing 14, to give the impression of neon. That is, the letters 40 give the appearance that the source is within the letters 40 and projects radially outwardly therefrom through approximately 270°.

Figure 6:
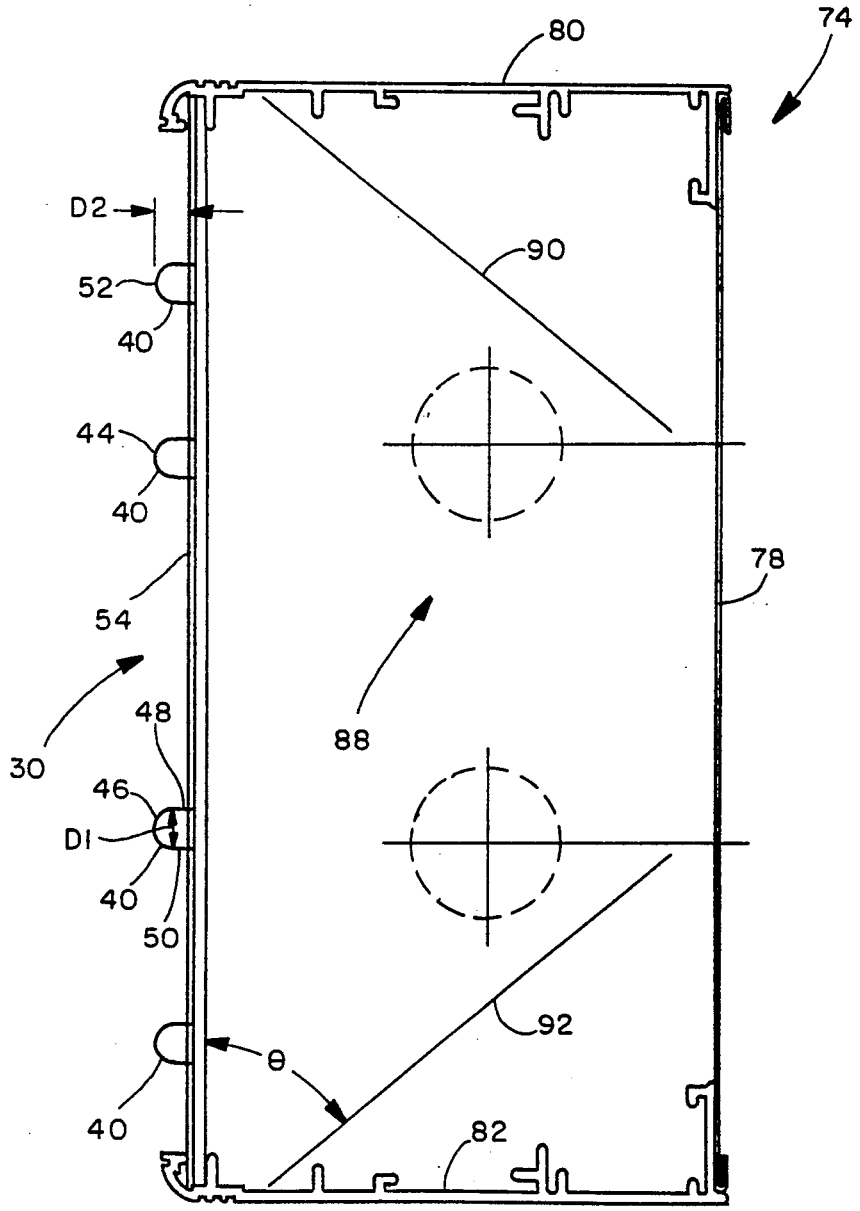
FIG. 6 is a cross-sectional view of the assembled, modified sign according to the present invention.

A preferred form for the letters 40 is shown in FIG. 6. In cross section, each letter 40 is shown to be defined by an outer surface 44 that is generally solid U-shaped, opening rearwardly. The outer surface 44 consists of a forward, convex surface segment 46 defined by a diameter D1 which blends into spaced, parallel, straight segments 48, 50, which are tangent to the surface segment 46.

In a preferred form, the diameter D1 is approximately ⅜ of an inch and the distance D2 between the apex 52 of the surface segment 46 and the forwardmost surface 54 on the message carrying wall 30 is approximately ⅜ inch.

Returning to FIGS. 1-3, in conjunction with FIG. 6, the rear surface 56 of the panel 34 is seen to be tinted where it coincides with the letters 40. The particular color used is a design consideration. The color can be applied by techniques well known to those skilled in the sign art. Light from the bulbs 22, 24, 26 will cause the forward projection of the selected color light through the front of the sign 10.

The remaining portion of the panel 34 is made opaque by applying a coating on the rear surface 56 thereof.

The remaining portion of the panel 34 is made opaque by applying a coating 57 on the rear surface 56 thereof. The coating is preferably a white latex painted surface that will reflect light, for reasons discussed below.

The front panel 32 serves as an opaque mask for the front of the sign 10 and normally has a contracting color to that of the letters 40 to highlight the letters 40. The panel 32 has cut-outs 58 therein for close reception of the raised letters 40. The cut-outs 58 may be preformed, die cut, laser cut, or otherwise formed by methods known to those skilled in the art. The panel 32 may be black or smoke colored material, brushed aluminum, or the like, that is capable of preventing light transmission therethrough.

The panel 32 has a flat rear surface 60 which facially abuts the planar surface 42 on the panel 34 with the panel 32, 34 operatively engaged as a subassembly which is snap-fit to the housing 14 as by conventional clips 62 in cooperating receptive openings 64 in the housing 14.

Light from the bulbs 22, 24, 26 projects through the translucent portion of the panel 34 to illuminate the letters 40. To enhance the amount of light transmission through the letters 40, reflectors 66, 68, 70, for cooperation with the bulbs 22, 24, 26, respectively, are provided. The reflectors 66, 68, 70 coupled be formed as a unit or by joining separate pieces. Exemplary reflector 66 is described in relationship to its cooperating bulb 22.

The reflector 66 defines a forwardly opening, U-shaped reflecting surface 72 which disperses light projected rearwardly from the bulb 22 forwardly through the translucent portions of the panel 34. This enhances the intensity of the light transmission at the front of the sing 10 and tends to eliminate light voids. The coating, which is preferably white painted surface, on the rear surface 56 of the panel 34, intercepts light rays that do not pass through the letters 40 and directs these rays back to the reflector 66 to be dispersed in a forward direction.

Figure 4:
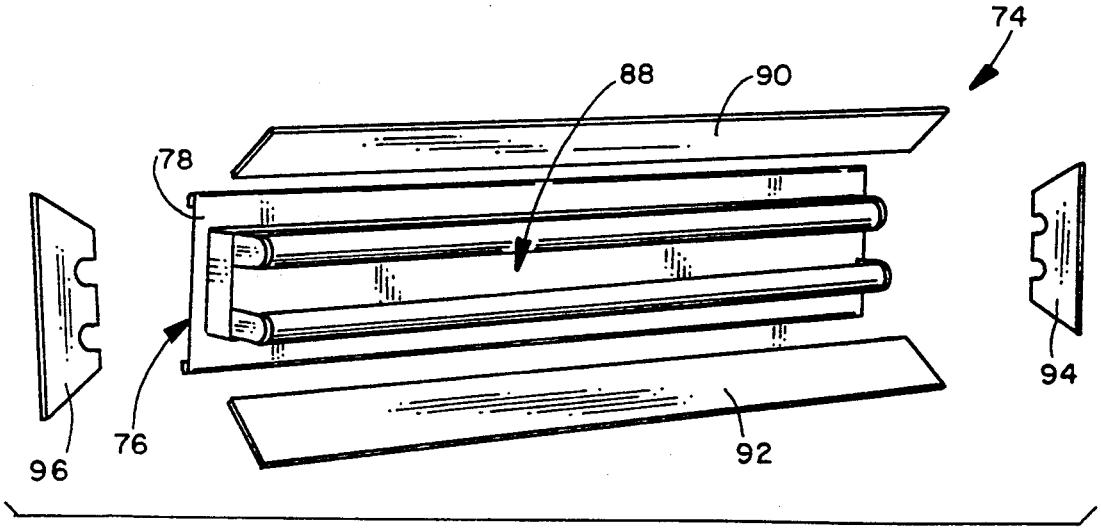
FIG. 4 is an exploded perspective view of an illumination source and light reflecting structure according to a modified form of the invention.
Figure 5:
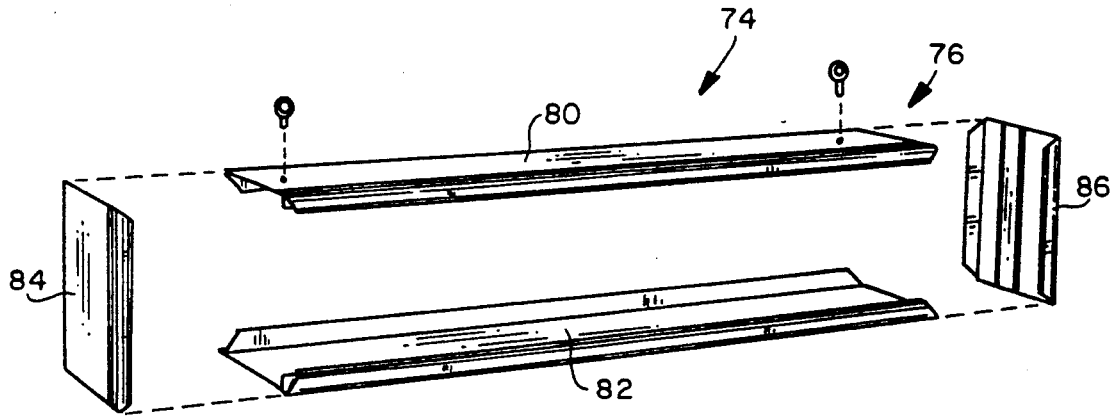
FIG. 5 is an exploded perspective view of a housing for containing the structure in FIG. 4.

A slightly modified form of sign, according to the present invention, is shown at 74 in FIGS. 4-6. The sign 74 has a housing 76 defined by a rear panel 78, top and bottom panels 80, 82, respectively, and end panels 84 86. The panels 78-86 cooperatively define a component space of the message carrying wall 30 and a two bulb light source at 88. The primary difference between the sing 74 and that 10 in FIGS. 1-3, is in the arrangement of reflectors.

More specifically, the sign 74 has upper and lower inclined reflectors 90, 92 and angled end reflectors 94, 96. The reflectors 90, 92 each make an angel Θ with the plane of the forwardmost surface 54 of the message carrying wall 30. The angle Θ, in a preferred from , is approximately 50°. The end deflectors 94, 96 are also preferably inclined at a similar angel with respect to the surface 54. The reflectors are provided on the sign 74 primarily to intensify forward light projection and eliminate voids. The reflecting surfaces may be, for example, mirrored acrylic or polished metal.

It can be seen that the inventive sign is easy and relatively inexpensive to construct, durable and convenient to maintain. Virtually the only regular maintenance required is the periodic replacement of bulbs. The signs can be constructed according to the invention in virtually any size and shape.

The foregoing disclosure of specific embodiments is intended to be illustrative of the broad concepts comprehended by the invention.

I claim:

1. An illuminated sign comprising:

a message carrying wall having a front display side and a rear side;

said message carrying wall having a portion that is opaque to block light transmission therethrough from a source on the rear side of the message carrying wall, said wall having a translucent portion that allows light transmission therethrough from a source on the rear side of the message carrying wall to produce an illuminated message that is visually detectable at the front side of the message carrying wall;

lenticular means at the front of the message carrying wall for intercepting light transmitted from a source on the rear side of the message carrying wall through the translucent portion of the message carrying wall to redirect the light in such a way as to give the appearance of a light source at the front of the message carrying wall, said message carrying wall having a forwardly facing surface and a rearwardly facing surface, said lenticular means comprising at least one raised element projecting forwardly from the forwardly facing surface of the message carrying wall, said one raised element in cross section having a curved forward outer surface segment and a straight segment extending between the curved forward outer surface segment and the forwardly facing surface of the message carrying wall;

a light source;

a reflector having a forwardly facing reflecting surface; and means for mounting the light source between the forwardly facing reflecting surface and lenticular means to deflect light from the light source forwardly to and through the lenticular means;

said rearwardly facing surface of the message carrying wall being directly exposed to the light source and having a light reflective coating thereon to direct light from the light source impinging on the rearwardly facing surface back towards the reflector.

2. The illuminated sign according to claim 1 wherein the message carrying wall comprises first and second panels, said first panel comprising one piece defining the lenticular means which lenticular means comprises a plurality of spaced, raised elements and the second panel being opaque and defining cutouts for the lenticular means which project forwardly through the cutouts with the first and second panels in operative relationship, said second panel being defined as one piece that extends continuously over the entire extent of the message carrying wall.

3. The illuminated sign according to claim 2 wherein the first panel is tinted with at least one color so that light projecting forwardly through the translucent portion of the message carrying wall has said one color.

4. The illuminated sign according to claim 1 wherein the light source comprises at least one fluorescent tube.

5. The illuminated sign according to claim 1 wherein the lenticular means comprises a plurality of raised elements which cooperatively produce the message that is visually detectable at the front side of the message carrying wall, said plurality of raised elements being defined as one piece extending continuously over the entire extent of the message carrying wall.

6. The illuminated sign according to claim 5 wherein each raised element is elongate and in cross section taken transversely of its length has a generally solid U-shaped outer surface exposed at the front of the forwardly facing panel surface.

7. The illuminated sign according to claim 6 wherein the curved forward outer surface is defined by an arc of a circle having a first diameter and two spaced, straight segments being substantially tangent to the forwardmost surface segments.

8. The illuminated sign according to claim 7 wherein the forwardmost surface segment has an apex and the spacing between the surface segment apex and the forwardly facing panel surface is less than the first diameter.

9. The illuminated sign according to claim 7 wherein the first diameter is approximately equal to $\frac{3}{8}$ inch and the distance between the surface segment apex and the forwardly facing panel surface is approximately equal to $\frac{1}{4}$ inch.

10. An illuminated sign comprising:

a housing defining a component mounting space and having a front and rear;

a light source;

means for mounting the light source within the component mounting space;

a message carrying wall having a front display side and a rear side;

means for mounting the message carrying wall at the front of the housing, said message carrying wall having a forwardly facing substantially flat surface and a translucent portion that allows light transmission forwardly therethrough from the light source to thereby produce a message that is visually detectable at the front side of the message carrying wall; and lenticular means projecting forwardly of the forwardly facing surface on the message carrying wall for redirecting light from the light source to effect diffusion thereof at the front of the message carrying wall to give the appearance that the light source is adjacent to the forwardly facing surface of the message carrying wall, said translucent portion of the message carrying wall comprising a panel that is integrally formed as one piece with the lenticular means, said lenticular means being formed as a solid piece projecting forwardly of the forwardly facing surface of the message carrying wall, said housing having top, bottom and side walls defining a reflector to direct light projected thereagainst from the light source forwardly through the lenticular means, said top and bottom walls having a light and diverging towards the front of the illuminated sign, said light source comprising a bulb having a length aligned with the length of the reflector and residing between the reflector and the message carrying wall.

11. The illuminated sign according to claim 10 wherein the lenticular means has a convex forward surface.

12. The illuminated sign according to claim 10 wherein the lenticular means is made from a clear acrylic material.

13. The illuminated sign according to claim 10 wherein the light source resides between the reflector and the message carrying wall and there is an air space between the reflector and the message carrying wall.

14. The illuminated sign according to claim 13 wherein the reflector has a plurality of elongate, concave, forwardly opening reflecting surfaces, there is a light source in front of each of the reflecting surfaces, and each light source comprises a fluorescent bulb having a length aligned lengthwise with one of the reflecting surfaces, each said bulb extending substantially the entire distance between the side walls of the housing.

15. The illuminated sign according to claim 13 wherein the reflector comprises two facing reflecting surfaces which converge from front to rear in the housing.

16. The illuminated sign according to claim 15 wherein at least one of the reflecting surfaces makes an angle of approximately 50° with the plane of the forwardly facing surface on the message carrying wall.

* * * * *

UNITED STATES PATENT AND TRADEMARK OFFICE

CERTIFICATE OF CORRECTION

PATENT NO. : 5,237,766

DATED : Aug. 24, 1993

INVENTOR(S) : Ray M. Mikolay

It is certified that error appears in the above-indentified patent and that said Letters Patent is hereby corrected as shown below:

Col. 6, line 60, delete "light" and insert --length-- therefor.

Signed and Sealed this

Twenty-fifth Day of April, 1995

*Attest:*

Bruce Lehman

BRUCE LEHMAN

*Attesting Officer*

*Commissioner of Patents and Trademarks*